US010308418B1

(12) United States Patent
Dakolios et al.

(10) Patent No.: US 10,308,418 B1
(45) Date of Patent: Jun. 4, 2019

(54) PROPEL/REPEL DISPENSER

(71) Applicant: Federal Package Network, Inc., Chanhassen, MN (US)

(72) Inventors: Steven R. Dakolios, Minnetrista, MN (US); Kendall L. Erickson, Eden Prairie, MN (US)

(73) Assignee: Federal Package Network, Inc., Chanhassen, MN (US)

( * ) Notice: Subject to any disclaimer, the term of this patent is extended or adjusted under 35 U.S.C. 154(b) by 0 days.

(21) Appl. No.: 15/829,359

(22) Filed: Dec. 1, 2017

(51) Int. Cl.
*B05C 17/01* (2006.01)
*B65D 83/00* (2006.01)

(52) U.S. Cl.
CPC ..... *B65D 83/0011* (2013.01); *B05C 17/0116* (2013.01)

(58) Field of Classification Search
CPC . A45D 40/04; A46B 11/0027; B05C 17/0116; B05C 17/0133; B65D 83/0011; F16H 25/20; F16H 25/2015; F16H 25/2012; F16H 25/2025
USPC ..... 401/175
See application file for complete search history.

(56) References Cited

U.S. PATENT DOCUMENTS 5,320,467 A 6/1994 Erbes
5,573,341 A 11/1996 Iaia
5,727,891 A 3/1998 Lang
5,842,802 A 12/1998 Lang
5,947,621 A 9/1999 Szekely
6,129,471 A 10/2000 Lang
6,241,408 B1 6/2001 Lang
9,585,460 B2 3/2017 Wade et al.
2002/0006305 A1* 1/2002 Petit ..... A45D 40/04 401/70
2006/0013640 A1* 1/2006 Skakoon ..... A45D 40/04 401/175
2009/0080963 A1 3/2009 Skakoon et al.

* cited by examiner

*Primary Examiner* — David D Angwin
*Assistant Examiner* — Bradley S Oliver
(74) *Attorney, Agent, or Firm* — Breiner & Breiner, L.L.C.

(57) ABSTRACT

A screw-operated dispenser providing for prevention of breakage of an engaged screw when a user rotates a turn member in the wrong direction, i.e., repels rather than propels an elevator. A tubular body holds a supply of product, which is dispensed by action of the elevator along a threaded shaft upon turning a base to either propel or repel the elevator along the shaft which is threadably engaged with the elevator. Certain lowermost revolutions of the thread on the shaft are chamfered at the bottom edge thereof so that when the elevator is in a lowermost position on the screw shaft and a user mistakenly rotates the turn member in a repel direction, the thread of the elevator will not engage, i.e., will override, the thread of the screw shaft thereby eliminating stress and/or pressure between the threads which may result in breakage of the screw shaft and render the dispenser inoperable.

15 Claims, 5 Drawing Sheets

PROPEL/REPEL DISPENSER

FIELD OF THE INVENTION

The invention relates to a screw-operated propel/repel dispenser for dispensing a highly viscous product, such as a substantially solid or solid product. More particularly, the invention relates to a screw-operated propel/repel dispenser having an improved screw which prevents breakage of the screw when a user operates the dispenser to move the screw in a repel direction when the elevator of the dispenser is in a lowermost repel position, i.e., the user mistakenly turns the screw in the wrong direction placing stress and/or pressure on the screw.

BACKGROUND OF THE INVENTION

Screw-operated dispensers are known in the art. They are useful for dispensing products such as lip balms, cosmetics and the like.

In a screw-operated dispenser of the prior art such as shown in FIGS. 1, 2 and 2A, product to be dispensed sits within a tubular body 1 of cylindrical or other shape. The product is supported in the body by an elevator 3 which travels inside the body along the body's length. The elevator is threadably engaged with a shaft 5 of a dispensing screw 7 having a turn member 9. The threaded shaft 5 extends inside the tubular body along the body's length. The thread along each revolution thereof has a squared or straight angled edge to engage a mating thread in the elevator. Turn member 9 is seated in a dispenser base 11. In response to the turning of the base 11, which serves to rotate turn member 9, the elevator 3 is moved upward (propelled) or downward (repelled) depending on the direction the base 11 is rotated.

In operation of the above-described dispenser, a user turns the base 11, in which the turn member 9 is seated, causing the threaded shaft 5 of the screw 7 to turn, and thereby cause the elevator 3 to travel along the thread 13 inside the tubular body with concomitant movement of the product up or down from the dispensing opening in the body. The amount of product dispensed from or retracted into the body is proportionate to the extent to which the base 11 and turn member 9 are rotated.

A problem in the prior art propel/repel dispensers may occur when the elevator 3 is positioned at the bottom of the screw shaft 5, or repelled until it is in such position, and a user rotates or continues to rotate the base 11 and turn member 9 in a repel direction, that is in the wrong direction. This incorrect rotation may place stress and/or pressure on the screw which may result in breakage of the screw at the point of engagement between the thread on the screw shaft and the thread in the elevator. This will render the dispenser inoperable. Once the dispenser is inoperable, any undispensed product is wasted.

It would be advantageous to provide a screw-operated dispenser that prevents or eliminates the accidental breakage of the screw when a user rotates the base and turn member in the wrong direction, and in particular one that does not require complex and expensive dispensing structures.

SUMMARY OF THE INVENTION

The invention is directed to a screw-operated dispenser that has a thread structure which prevents or eliminates breakage of the screw in the event a user rotates the dispenser's screw in a repel direction when the elevator is in the lowermost repel position.

The invention comprises an improved threaded screw which is simple in structure and does not require costly additional parts or manufacturing and assembly steps to achieve the desired elimination of breakage of the screw.

Accordingly, a propel/repel dispenser is provided having an improved threading on the shaft of the screw. The screw thread in at least the lowermost about 1 to about 1.75 revolutions, preferably about 1.5 revolutions, of the screw thread adjacent the shoulder of a hub in the screw is chamfered so as to provide in the thread surface a bottom edge which is inclined or slanted and not at a right angle to a side wall of the thread. In the event a user causes the turn member to rotate in a repel direction when the elevator is movably engaged with the thread in a lowermost position on the screw shaft, the chamfered edge in at least the lowermost revolutions of the thread of the screw will cause the engaged elevator thread to override by sliding over or around the screw thread, thereby preventing breakage of the screw shaft and maintaining the operability of the dispenser.

The improved screw of the invention works particulary well when the hub of the screw is increased in length. This provides for additional spacing at the base of the screw shaft between the elevator and the bottom wall of the tubular body. This structure prevents the elevator from engaging the bottom wall of the tubular body and subjecting it to unwanted downward pressure which may cause the screw to break in the event the user turns the screw in the wrong direction. The lengthened hub may be provided by having two or more stacked hubs or by increasing the length of a single hub. The stacked hubs may provide for a sturdier screw and dispenser.

In use of the propel/repel dispenser of the invention, the product is stored within the tubular body. The product is supported in the body by the elevator as a support which travels inside the body along the body's length. The elevator is received on a threaded shaft of a dispensing screw of the invention. The shaft of the dispensing screw is inside the tubular body. At the end of the screw is a turn member. The turn member is fitted into a base which in conjunction with the screw is connected to the tubular body. The base has a mating configuration to maintain the turn member in place in the base and to cause the turn member to rotate in response to rotation of the base by a user.

Rotation of the turn member of the dispensing screw turns the threaded shaft which causes the elevator to move up or down inside the tubular body with concomitant extension or retraction of the product from the open dispensing end of the body.

The screw-operated dispenser of the invention is configured such that the turn member when caused to be rotated in one direction propels the elevator and product supported thereon upward and out of the container through the top opening in the tubular body, and when turned in a second and opposite direction repels the elevator downward to a lowermost position on the threaded shaft. If a user mistakenly rotates the turn member in a repel direction when the elevator is in a lowermost position, the lower chamfered revolutions of the screw thread allow the thread of the elevator to override or to slip past the thread on the screw shaft. Therefore, such incorrect rotation of the turn member will not place stress and/or pressure on the engaged threads of the screw, thereby preventing breakage of the screw shaft and rendering the dispenser inoperable.

BRIEF DESCRIPTION OF THE DRAWINGS

The following detailed description of the specific non-limiting embodiments of the present invention can be best understood when read in conjunction with the following drawings, where like structures are indicated by like reference numbers.

DETAILED DESCRIPTION OF THE INVENTION

Having described the invention in general terms, a description of presently preferred embodiments is set forth with reference to the drawings.

Figure 3:
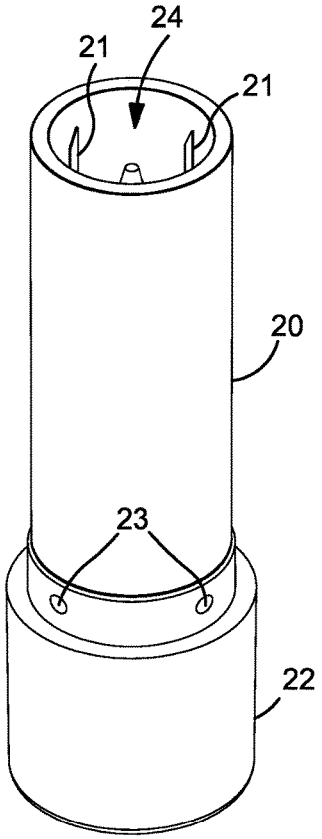
FIG. 3 is a perspective view of a tubular body and base of a propel/repel dispenser of the invention.

Referring to FIG. 3, a perspective view of a propel/repel screw-operated dispenser of the invention is shown. Tubular body 20 is shown in the preferred form of a cylinder. A base 22 is attached in a conventional manner to tubular body 20 to allow rotation of base 22 in relation to body 20. For convenience of discussion, the propel/repel dispenser will be described and shown in terms of a lip balm stick applicator. Necessarily variations in size and shape are possible depending on the use of the product contained in the dispenser. For example, conventional lip balm applicators have a body size of approximately ⅝" in diameter and 2" in length. The tubular body is, as well as the other parts of the applicator, preferably manufactured from plastic as conventionally known in the art. Body 20 has an open dispensing end 24. A removable cap (not shown) fits on top of the body 20 extending the length of the body and engaging projections 23 and seating on the shoulder of base 22, thereby providing an aesthetically pleasing appearance.

Dispensing screw 26 includes a turn member 28, shaft 29 having a screw thread 30 formed therewith, and a hub 32 between the shaft 29 and turn member 28. Hub 32 includes a shoulder 32*a*. In the embodiment shown, the hub 32 is comprised of two substantially similar hub structures in stacked relation. Turn member 28 includes a plurality of parallel ridges 34 which mate with a plurality of corresponding parallel ridges (not shown) in the inside of base 22 as discussed below. Screw 26 is preferably a one piece injection molded plastic structure, a preferred plastic being polypropylene.

Figure 6:
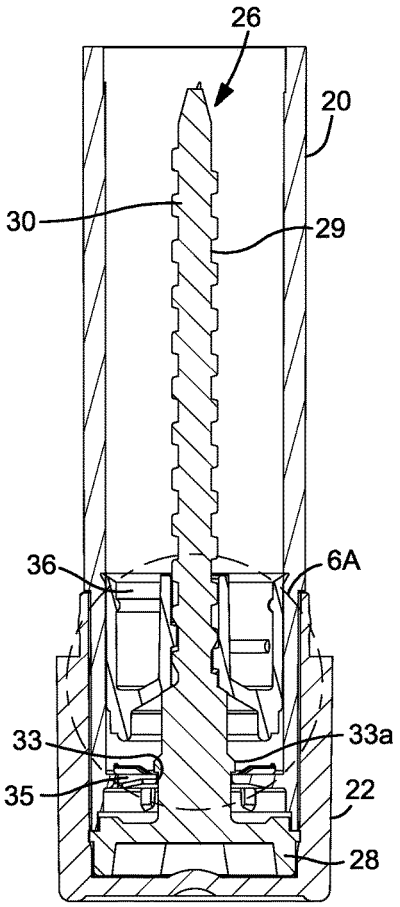
FIG. 6 is a cross-sectional view of a propel/repel dispenser of the invention having assembled therein in operating engagement the screw as shown in FIGS. 4 and 4A and the elevator as shown in FIG. 5.
Figure 6A:
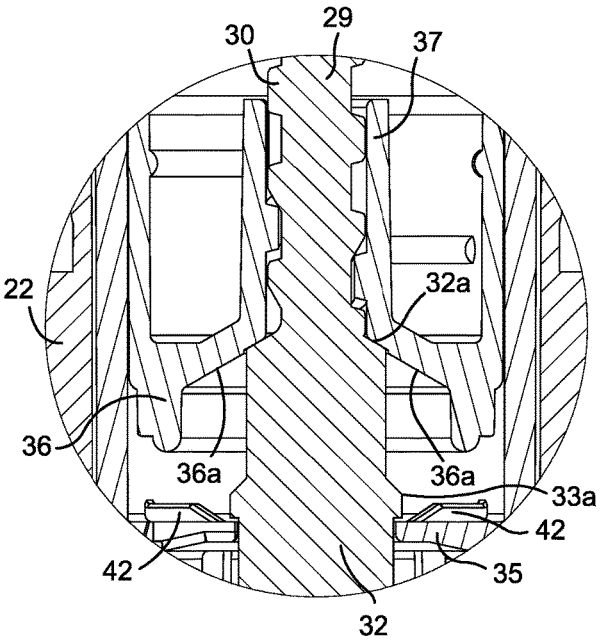
FIG. 6A is a detail view of the screw engaged with the elevator as shown in the circled portion 6A of FIG. 6.

Referring, for example, to FIGS. 4, 4A, 6 and 6A, screw 26 is seated in base 22 such that ridges 34 of screw 26 engage the corresponding ridges in base 22. This prevents the rotation of screw 26 in base 22 and allows rotation of base 22 to rotate screw 26. Base 22 with screw 26 are attached to body 20 by insertion through an opening 33 in a bottom wall 35 of the tubular body 20. As best shown in FIGS. 6 and 6A, hub 32 includes a bead 33*a* which fits through opening 33 and which holds base 22 and screw 26 within body 20, i.e. the arrow head shape of bead 33*a* prevents removal of base 22 and screw 26 from body 20. Base 22 acts as the portion of the dispenser which a user will turn to cause turn member 28 to rotate which causes shaft 29 to rotate. Accordingly, shaft 29 of screw 26 lies in a vertically fixed position inside body 20 and is rotatable by means of base 22 in conjunction with turn member 28.

Also present inside body 20 is a product support or elevator 36 which is threadably engaged with threaded shaft 29. Elevator 36 moves along the length of body 20 in response to turning of base 22 and thereby turn member 28. Elevator 36 and body 20 are structured to cooperate in a conventional manner to prevent elevator 36 from rotating about the axis of screw shaft 29. For example, ribs 21 can be present on the interior wall of body 20 which interact with projections 25 on the exterior of elevator 36 to maintain elevator 36 in a non-rotating position as it moves up or down shaft 29. The product to be dispensed sits in and on top of elevator 36.

In use, base 22 and turn member 28 are rotated in a propel direction thereby rotating threaded shaft 29 causing elevator 36 to move upward along shaft 29 inside body 20 and raise the uppermost portion of product out of dispensing end 24. Following dispensing of product, the base 22 and thereby turn member 28 is rotated in the opposite direction to repel the elevator 36 downward along shaft 29 until the product no longer extends out of opening 24. When the dispenser is full of product or fully repelled when product has been partially dispensed, the elevator 36 will be in a lowermost position as shown, for example, in FIGS. 6, 7A and 7B where a bottom portion 36*a*, see e.g. FIG. 6A, of the elevator 36 is adjacent to the shoulder 32*a* of hub 32. Hub 32 has a sufficient length or height which allows the downward extension of the elevator 36 to be positioned above the top surface of turn member 28.

Figure 1:
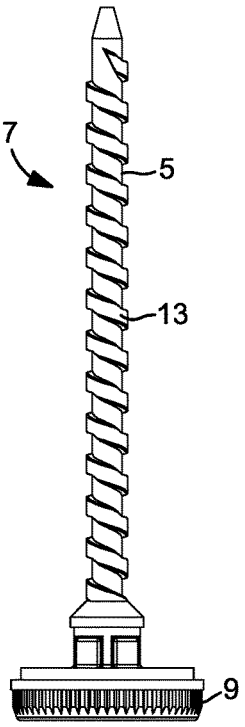
FIG. 1 (PRIOR ART)
FIG. 1 shows a side view of a prior art screw.
Figure 2:
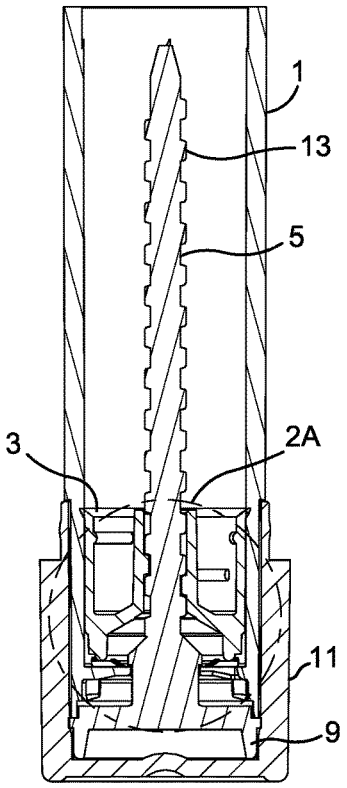
FIG. 2 (PRIOR ART)
FIG. 2 shows a cross-sectional view of the screw of FIG. 1 in operating engagement with an elevator in a prior art propel/repel dispenser.
Figure 2A:
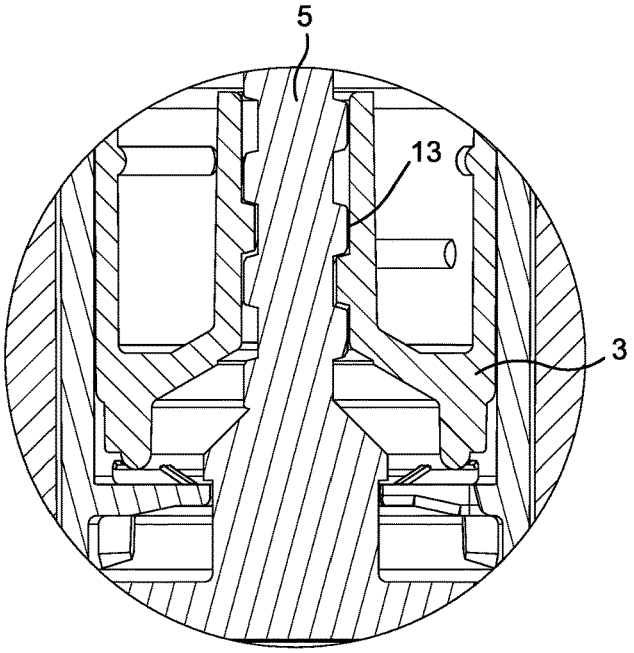
FIG. 2A (PRIOR ART)
FIG. 2A is a detail view of the screw and elevator as shown in the circled portion 2A of FIG. 2.

The thread 30 on shaft 29 is a single thread generally having top wall, side wall and bottom wall surfaces. The top wall surface and bottom wall surface are substantially at a right angle to the side wall surface and have a substantially square profile, except at the bottom portion as discussed below. The thread 30 engages thread 38 in the inner channel 37 of elevator 36 for moving the elevator upward and downward along the thread 30 on shaft 29 upon rotation of base 22 and turn member 28. In a conventional screw 7 as shown in FIGS. 1, 2 and 2A, the thread 13 has the same wall configuration for each revolution along the entire length of the shaft 5, including at the base of the shaft as shown in detail in FIG. 2A. This presents a problem when the elevator 3 is moved to or in a lowermost position on the shaft and a user rotates turn member 9 in a repel or wrong direction. This action provides stress and/or pressure on the screw 7 which can result in breakage of the screw shaft 5 rendering the dispenser inoperable and causing a waste of any undispensed product. A user may be dissatisfied with the dispenser, the waste of the product and/or the need to purchase a new product.

Figure 4:
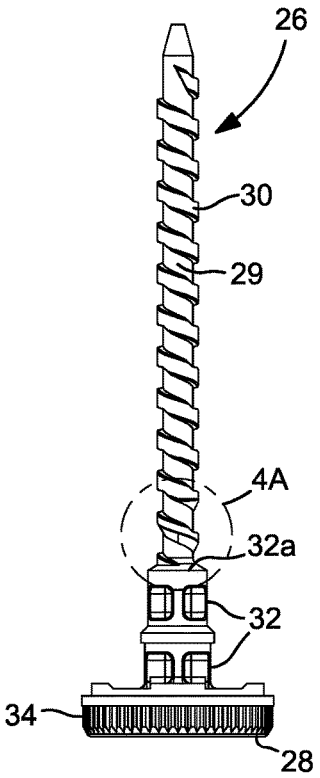
FIG. 4 shows a side view of a screw of the invention.
Figure 4A:
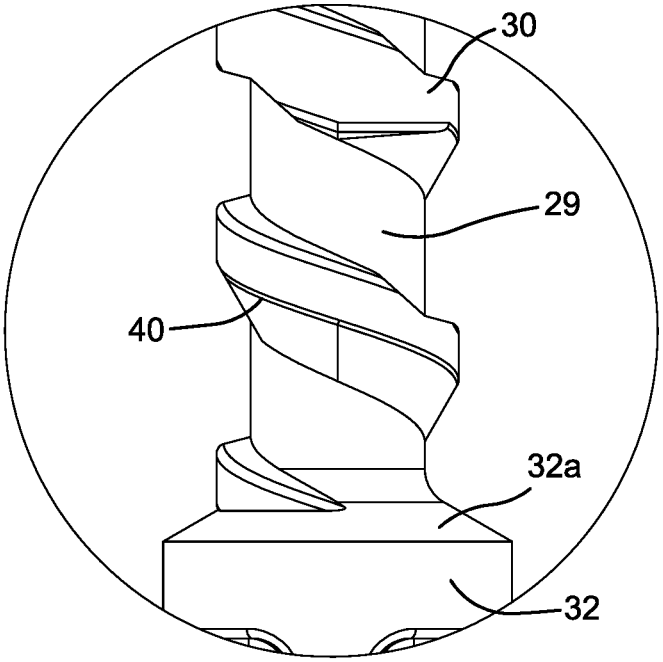
FIG. 4A is a detail view of the lowermost revolutions of the screw thread adjacent the shoulder of the hub of the screw as shown in the circled portion 4A of FIG. 4.
Figure 5:
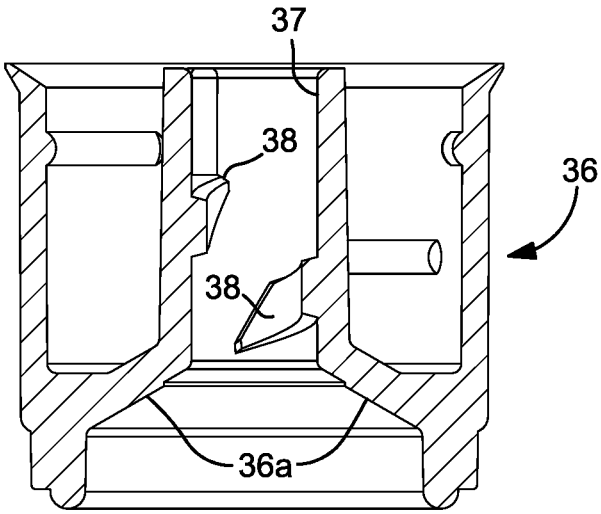
FIG. 5 is a cross-sectional view of the elevator of the propel/repel dispenser of the invention.
Figure 7A:
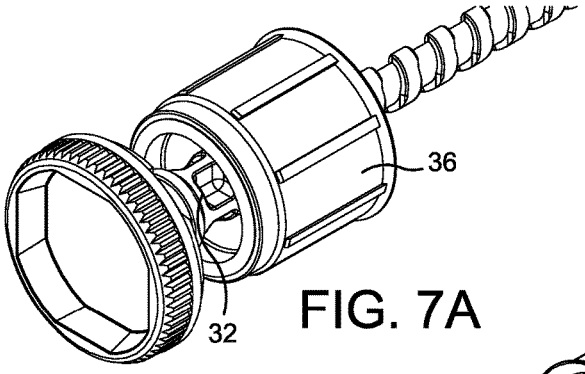
FIG. 7A shows a partial bottom perspective view of the elevator engaged with the thread on the shaft of the screw of the invention when the elevator is in a substantially lowermost repelled position.
Figure 7B:
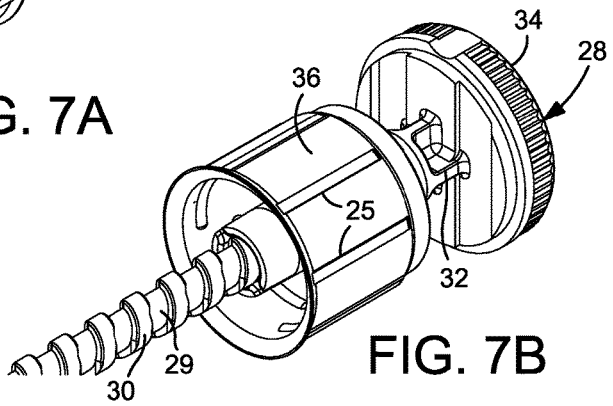
FIG. 7B shows a partial top perspective view of the elevator engaged with the thread on the shaft of the screw of the invention when the elevator is in a substantially lowermost repelled position.
Figure 8A:
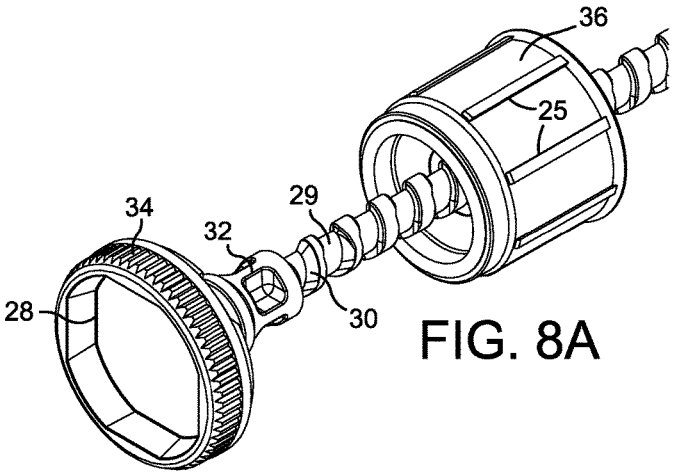
FIG. 8A shows a partial bottom perspective view of the elevator engaged with the thread on the shaft of the screw of the invention when the elevator is in a partly propelled position along the threaded shaft.
Figure 8B:
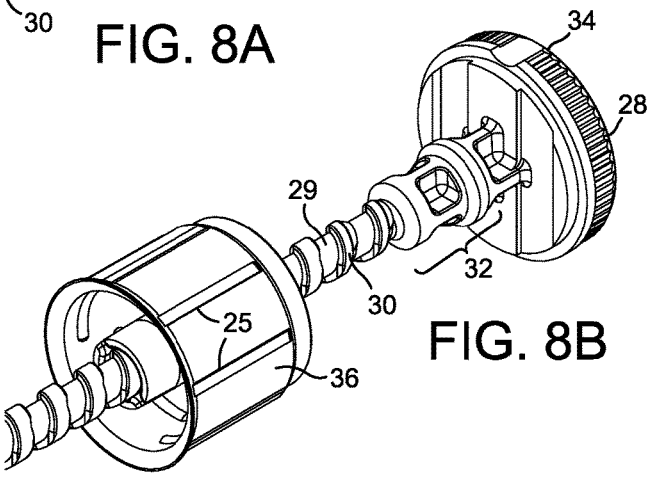
FIG. 8B shows a partial top perspective view of the elevator engaged with the thread on the shaft of the screw of the invention when the elevator is in a partly propelled position along the threaded shaft, and a double stacked hub structure is also shown.

The screw 26 of the invention prevents breakage of the screw shaft when a user rotates the base 22 and turn member 28 in the wrong direction. The thread 30 on shaft 29 of the invention in at least the lowermost revolutions of thread 30 on shaft 29 are chamfered at the bottom edge of the thread as best seen in FIGS. 4 and 4A. This chamfered thread provides an edge 40 to the thread which is inclined or slanted, i.e., not at a right angle to the thread side wall and not having a generally square profile. The chamfered edge is provided to at least the lowermost about 1 to about 1.75 revolutions of the thread. Preferably, the chamfered edge is provided to about 1.5 revolutions of the lowermost revolutions of thread 30. The thread ends on or adjacent to the shoulder 32*a* of hub 32. When a user turns the base 22 in a repel direction when the elevator 36 is in a lowermost position, i.e., in the wrong direction, the thread 38 of the elevator 36 upon the pressure of the turn will override or slip over, i.e., move past, the thread 30 due to the chamfered edge 40 of the lower revolutions of thread 30. The thread 38 of the elevator does not, therefore, engage the thread 30 of the shaft 29 when the user turns the base in the wrong (repel) direction. This structure and action prevents breakage of the screw shaft. Continued dispensing operation occurs when a user recognizes their error and reverses the turn direction of the base 22 to propel the elevator upward along the thread 30 on shaft 29. The chamfered edge 40 does not prevent the upward motion of the elevator 36 along thread 30 on shaft 29. FIGS. 7A and 7B show, in absence of the tubular body 20 and base 22 for clarity, the elevator 36 positioned adjacent the shoulder 32*a* of hub 32 as shown in FIG. 6A. FIGS. 8A and 8B show, also in the absence of body 20 and base 22, elevator 36 moved partway upward on shaft 29 along thread 30.

In a preferred embodiment, hub 32 can be provided with a length or height to provide shoulder 32*a* at a height sufficient to maintain the bottom surface of elevator 36 above the top of bottom wall 35 of body 20. This increased length may be provided by having two or more hubs formed in a stacked configuration such as shown in FIGS. 4 and 8 or by increasing the height of a single hub structure (not shown). The stacked configuration is preferred as providing a sturdier structure. This also serves to prevent interference between the elevator and other structure which may be present on the top of bottom wall 35 such as upward projections 42 or structure present on the top of turn member 28.

The invention provides a dispenser of simple construction which provides the desired function of dispensing while preventing breakage of the screw and which can be made at a reasonable cost. The invention provides an improved dispenser by modification of existing components such that no additional materials are required or added steps in assembly. The features of the invention may be incorporated into existing molds and, thus, the structure and assembly are inexpensive and not complex while providing an improved dispenser.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A screw-operated dispenser comprising:

a body including an open dispensing end and a base wall having at least one opening therethrough;

an elevator configured for vertical movement in said body, said elevator being in contact with an inner wall of said body so as to prevent rotation of the elevator in the body;

a screw including a turn member, a hub extending upward from a top surface of the turn member, a shaft extending upward from said hub, and said shaft having a screw thread thereon wherein said screw thread comprises a single screw thread having a top wall surface, a side wall surface and a bottom wall surface wherein the top wall surface and the bottom wall surface are substantially at a right angle to the side wall surface and having a substantially square profile;

said shaft and a portion of said hub extends through said at least one opening in the base wall into said body and along a substantial length of said body;

said elevator is positioned on said shaft with said screw thread being engaged with a thread in an inside channel of said elevator, and said elevator being movable upward and downward along said shaft upon rotation of said screw; and wherein the improvement comprises at least about one revolution of said screw thread in a lower portion of said screw thread adjacent said hub has a chamfered edge at the bottom wall surface of the thread to provide an inclined surface having an angle adapted to allow the thread in said inside channel of said elevator to override said screw thread having said chamfered edge when said screw is rotated in a direction to repel said elevator.

2. The dispenser of claim 1, wherein said at least one revolution having said chamfered edge is about 1 to about 1.75 revolutions.

3. The dispenser of claim 1, wherein said at least one revolution having said chamfered edge is about 1.5 revolutions.

4. The dispenser according to claim 1, wherein said body is substantially cylindrical.

5. The dispenser of claim 1, wherein said dispenser is made of plastic.

6. The dispenser of claim 1, wherein said hub further comprises a second hub in stacked relation to said hub.

7. The dispenser of claim 1 further comprising a base attached to the bottom of said tubular body and which engages said turn member of said screw, wherein said base may be rotated to propel and repel said elevator.

8. A screw for a screw-operated propel/repel dispenser comprising a turn member, a hub extending upward from a top surface of the turn member, a shaft extending upward from said hub, and said shaft having a screw thread thereon wherein said screw thread comprises a single screw thread having a top wall surface, a side wall surface and a bottom wall surface wherein the top wall surface and the bottom wall surface are substantially at a right angle to the side wall surface and having a substantially square profile, wherein the improvement comprises at least about one revolution of said screw thread in a lower portion of said screw thread adjacent said hub has a chamfered edge at the bottom wall surface of the thread to provide an inclined surface having an angle which is adapted to allow the screw thread when engaged with an inside channel of an elevator of said screw-operated propel/repel dispenser to override said screw thread having said chamfered edge when said screw is rotated in a direction to repel said elevator.

9. The screw of claim 8, wherein said at least one revolution having said chamfered edge is about 1 to about 1.75 revolutions.

10. The screw of claim 8, wherein said at least one revolution having said chamfered edge is about 1.5 revolutions.

11. The screw of claim 8, wherein said screw is made of plastic.

12. The screw according to claim 8, wherein said hub further comprises a second hub in stacked relation to said hub.

13. A plastic screw-operated dispenser comprising:

a cylindrical body including an open dispensing end and a base wall having at least one opening therethrough;

an elevator configured for vertical movement in said body, said elevator being in contact with an inner wall of said body so as to prevent rotation of the elevator in the body;

a screw including a turn member, a hub extending upward from a top surface of the turn member, a shaft extending upward from said hub, and said shaft having a screw thread comprising a single thread thereon having a top wall surface, a side wall surface and a bottom wall surface wherein the top wall surface and the bottom wall surface are substantially at a right angle to the side wall surface and having a substantially square profile;

said shaft and a portion of said hub extends through said at least one opening in the base wall into said body and along a substantial length of said body;

a base attached to the bottom of said tubular body and which engages said turn member of said screw, wherein said base may be rotated to propel and repel said elevator;

said elevator is positioned on said shaft with said screw thread being engaged with a thread in an inside channel of said elevator, and said elevator being movable upward and downward along said shaft upon rotation of said screw; and wherein the improvement comprises at least about one revolution of said screw thread in a lower portion of said screw thread adjacent said hub has a chamfered edge at the bottom surface of the thread to provide an inclined surface having an angle adapted to allow the thread in said inside channel of said elevator to override said screw thread having said chamfered edge when said screw is rotated in a direction to repel said elevator.

14. The dispenser of claim 13, wherein said at least one revolution having said chamfered edge is about 1 to about 1.75 revolutions.

15. The dispenser of claim 13, wherein said at least one revolution having said chamfered edge is about 1.5 revolutions.

* * * * *